United States Patent [19]

Wagner

[11] 4,342,453

[45] Aug. 3, 1982

[54] SKI TRAINING APPARATUS

[76] Inventor: Richard R. Wagner, 5930 Penfield Ave., Woodland Hills, Calif. 91367

[21] Appl. No.: 256,035

[22] Filed: Apr. 21, 1981

[51] Int. Cl.[3] ..... A01B 23/04

[52] U.S. Cl. ..... 272/97; 434/253

[58] Field of Search ..... 272/97, 63, 96, 146, 272/134; 128/25 R, 25 B; 434/253

[56] References Cited

U.S. PATENT DOCUMENTS

| | | | |
|---|---|---|---|
| 2,274,081 | 2/1942 | Mautin | 272/97 |
| 2,573,808 | 11/1951 | Ravoire | 272/97 |
| 3,461,857 | 8/1969 | Poulin | 272/97 X |
| 3,524,641 | 8/1970 | Ossenkop | 272/97 |
| 3,531,110 | 9/1970 | Marchu | 272/97 |
| 3,591,172 | 7/1971 | Hude | 272/97 |
| 3,650,528 | 3/1972 | Natterer | 272/132 X |
| 3,731,919 | 5/1973 | Schurch | 272/97 |
| 3,791,645 | 2/1974 | Stelma | 272/97 |

FOREIGN PATENT DOCUMENTS

| | | | |
|---|---|---|---|
| 675742 | 7/1952 | United Kingdom | 272/96 |

*Primary Examiner*—Richard J. Johnson
*Attorney, Agent, or Firm*—Keith D. Beecher

[57] ABSTRACT

Ski training apparatus is provided which includes a base, and a pair of spaced and parallel horizontal bars supported on the base and displaced upwardly from the plane thereof in uniplanar relationship, and a third horizontal bar extending perpendicular to and traversing the pair of bars supported on the base and displaced up from the pair of bars. A first bushing is slidably supported on the third bar, and a pair of bushings are slidably supported on the pair of bars. An intermediate block is mounted between the pair of bushings, and it is pivotally coupled to the bushings for rotation about an axis perpendicular to the axes of the pair of bars. A pair of ski-like boards are pivotally mounted at their front ends on the first bushing in spaced uniplanar relationship. A compression spring is mounted on the pivotal block, and it extends upwardly from the plane of the pair of bars, and a horizontal transverse strip member is mounted on the upper end of the spring, and it extends parallel to the second bar. Finally, the ski-like boards are pivotally mounted at their rear ends to the transverse strip member. Ski harness is mounted on the ski-like boards in position such that the heels of the skier are directly over the transverse strip member.

4 Claims, 3 Drawing Figures

SKI TRAINING APPARATUS

BACKGROUND

Teaching and practicing skiing on snow have many drawbacks. Among the drawbacks is the fact that in many localities the winter season is short, and skiers must often travel long distances to find appropriate ski slopes. This means that the average skier has a very short time to learn and practice the art, and yet his enjoyment of skiing is only in proportion to his proficiency.

In the art of skiing, the most important maneuver to be learned is the turn, which enables the skier to descend even though the most difficult slopes without losing control. In accordance with the parallel style of skiing, the turn is performed by the use of three basic motions. The first motion is one of unweighting, or upward lifting by standing up away from the snow, with the upper part of the body facing downhill. This angulation unwinds the feet through the elasticity of the body's midsection causing the feet (and skis) to point in the direction of the chest (downhill). The second half of the turn is accomplished by lowering the body down slightly (bending the knees) causing the skis to swing sideways to the slope of the hill, effecting speed reduction and control (edging). The third basic motion is the pole point, which ideally occurs at the moment the body reaches the lowest point (closest to the snow) at the end of the turn. This permits the cycle to repeat itself immediately, allowing the skier the maximum control of speed, the maximum number of turns, maximum control, and minimum effort.

It is accordingly, an objective of the present invention to provide apparatus on which the three essential motions may be practiced.

Specifically the objectives of the present invention are to provide apparatus whereby the motions of an expert skier may be practiced on a relatively simple, inexpensive structure; to provide apparatus by which the right and left turns which are executed by a skier by momentum caused by a rapid lift of his torso may also be practiced; and apparatus by which the skier may exercise the motions performed in a downward movement with the skis inclined downwardly forwardly and with the body correspondingly angled and with the weight balanced.

Another objective of the invention is to provide apparatus in which a skier may perform movements corresponding to those executed in skiing, in which the skier may exert intermittent pressure on his heels with an accompanying bending of his knees thus to effect a rapid up and down movement.

DETAILED DESCRIPTION OF THE ILLUSTRATED EMBODIMENT

Figure 1:
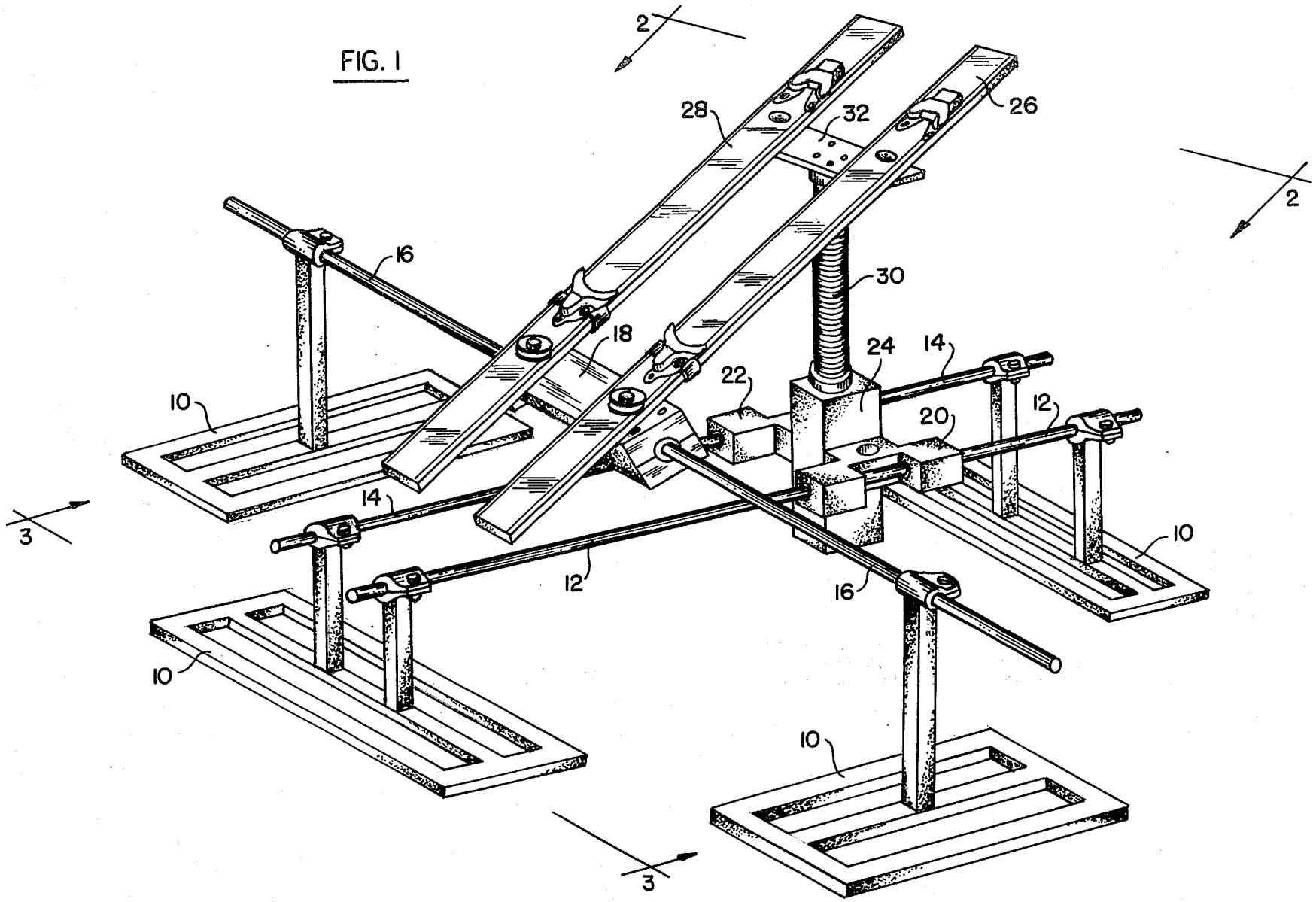
FIG. 1 is a perspective representation of apparatus constructed in accordance with one embodiment of the invention, taken from above and to one side.
Figure 3:
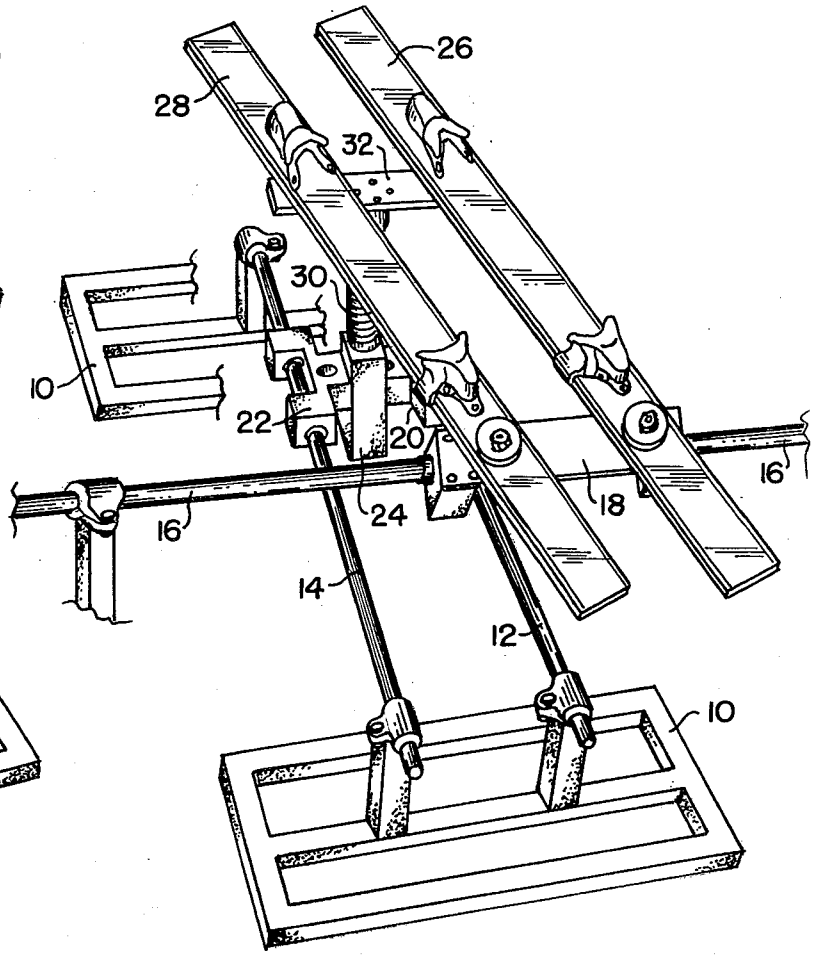
FIG. 3 is a further view of the apparatus of FIG. 1 taken from almost directly above the apparatus.
Figure 2:
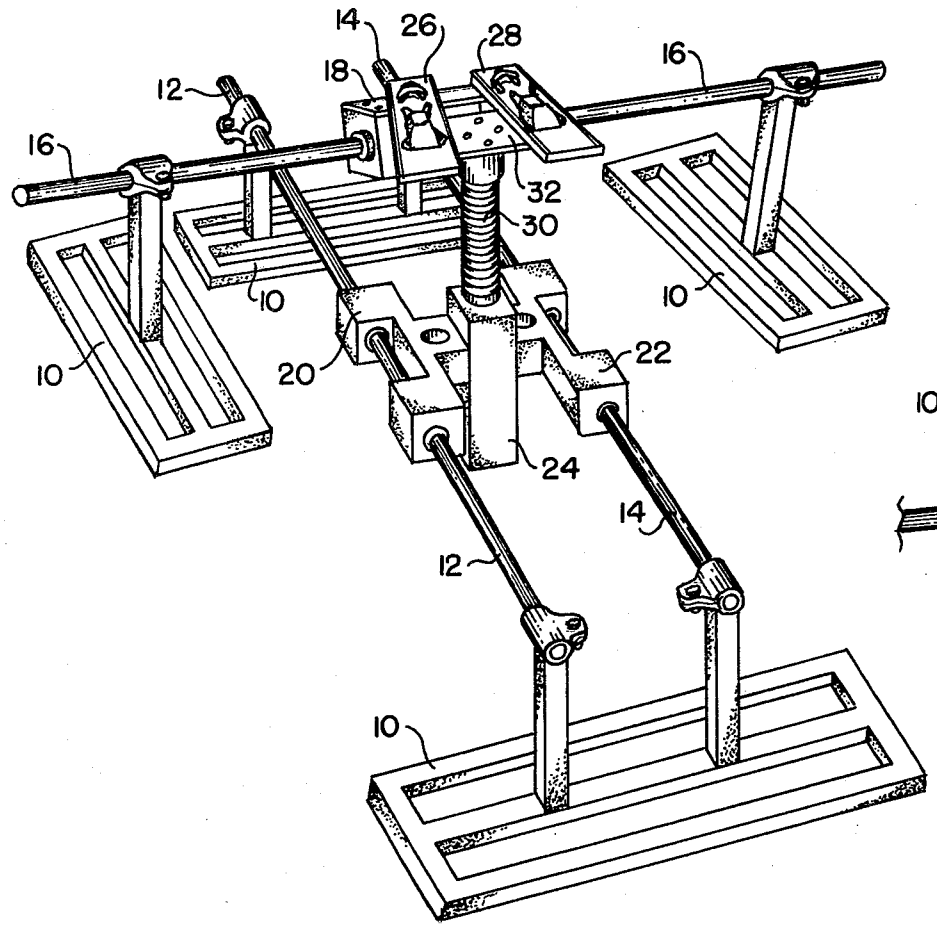
FIG. 2 is a further perspective representation of the apparatus of FIG. 1, taken from the front.

The apparatus shown in the drawing includes a base 10. Two spaced and parallel uni-planar horizontal bars 12 and 14 are supported on the base, and these bars are displaced upwardly from the base. A third horizontal bar 16 is also supported on base 10, and bar 16 extends perpendicular to bars 12 and 14, and is displaced upwardly from bars 12 and 14.

A slidable bushing 18 is mounted on bar 16, and a pair of slidable bushings 20 and 22 are mounted on bars 12 and 14. A block 24 is interposed between bushings 20 and 22.

A pair of ski-like boards 26 and 28 are pivotally coupled at their forward ends to bushing 18. A compression spring 30 is mounted on block 24, and the spring extends upwardly from the block. A horizontal strip 32 is pivotally secured to the top of the spring. The ski boards 26 and 28 are pivotally coupled at their rear ends to strip 32. Therefore, the ski boards are held in spaced and parallel uni-planar relationship by the strip 32 and by the bushing 18.

Appropriate ski bindings are mounted on the ski-like boards, as shown, and the bindings are positioned so that the heels of the skier are directly over the strip 22 on the top of spring 30.

It will be understood that when a skier stands on the ski-like members 26 and 28, the spring 30 is compressed, and the skier may bend his knees, and move his heels, exactly simulating skiing conditions, whereby the spring 30 expands and contracts. Also, as the spring 30 expands and contracts, the bushings 20 and 22 move back and forth on the rods 12 and 14.

The skier, assuming a normal skiing position, bends his knees, and executes turns in the manner described above. This causes the apparatus to turn, with the ski-like boards 26 and 28 at all times being held in the proper parallel position, while the various turns are being executed. When turns are executed the bushing 18 moves along the bar 16, and the skis turn in a parallelogram manner on the bushing 18 and strip 32.

The net result of the use of the apparatus shown and described above, is to train the skier to assume all the proper movements so that the turns may be properly executed. At all times, while the skier is on the apparatus, he experiences moves that are directly analogous to actual skiing.

It will be appreciated that while a particular embodiment of the invention has been shown and described, modifications may be made. It is intended in the claims to cover all modifications which come within the true spirit and scope of the invention.

What is claimed is:

1. Ski training apparatus comprising: a base; a pair of spaced and parallel horizontal bars supported on the base; a third horizontal bar supported on the base perpendicular to said pair of bars and displaced upwardly therefrom and extending thereacross; first bushing means slidably mounted on said pair of bars; second bushing means slidably mounted on said third bar; a compression spring coupled to said first bushing means and extending upwardly therefrom; and a pair of ski-like boards pivotally mounted at their forward ends to said second bushing means and pivotally mounted at their rear ends to said compression spring, said ski-like boards being held in spaced and parallel uni-planar relationship.

2. The ski training apparatus defined in claim 1, in which said first bushing means comprises a pair of bushings respectively slidably mounted on said pair of bars, and which includes a block interposed between said pair of bushings and pivotally coupled thereto for angular movement about an axis parallel to the axis of said third bar, and in which said compression spring is mounted at its lower end on said block.

3. The ski training apparatus defined in claim 2, and which includes an elongated strip member mounted on the top of said compression spring, said ski-like boards being pivotally coupled at their rear ends to said strip member.

4. The ski training apparatus defined in claim 3, and which includes ski harness mounted on each of said ski-like boards in position to hold the heels of the skier directly over said strip member.

* * * * *